US006565499B2

(12) United States Patent
Benzoni

(10) Patent No.: US 6,565,499 B2
(45) Date of Patent: May 20, 2003

(54) AUTOMATIC MACHINE FOR SLITTING AND CREASING PAPERBOARD SHEETS AND THE LIKE

(76) Inventor: Rinaldo Benzoni, Viale Toscanni, 6-20037 Paderno Dugnano (Milano) (IT)

( * ) Notice: Subject to any disclaimer, the term of this patent is extended or adjusted under 35 U.S.C. 154(b) by 180 days.

(21) Appl. No.: 09/753,147

(22) Filed: Jan. 2, 2001

(65) Prior Publication Data

US 2001/0009121 A1 Jul. 26, 2001

(30) Foreign Application Priority Data

Jan. 24, 2000 (IL) ..... MI2000A083

(51) Int. Cl.[7] ..... B31B 1/18

(52) U.S. Cl. ..... 493/199; 493/144; 493/228; 493/240; 83/332

(58) Field of Search ..... 493/141, 144, 493/228, 59, 240, 373, 119; 83/335, 334, 339, 294, 285, 298, 299, 332, 289

(56) References Cited

U.S. PATENT DOCUMENTS 2,830,506 A * 4/1958 Burroughs ..... 93/45
3,491,632 A * 1/1970 Dovey ..... 83/332
3,552,251 A * 1/1971 Neff et al. ..... 83/299
3,566,734 A * 3/1971 Robinson ..... 83/339
3,748,937 A * 7/1973 Long ..... 83/12
3,803,962 A * 4/1974 Koslow ..... 83/110
3,952,637 A * 4/1976 Lambert et al. ..... 93/58
4,402,240 A * 9/1983 Moyer ..... 83/343
4,708,708 A * 11/1987 Fries, Jr. ..... 493/357
4,962,684 A * 10/1990 Mowry ..... 83/332
5,300,009 A * 4/1994 Bittenbender ..... 493/373
5,344,377 A * 9/1994 Meeks ..... 493/368
5,863,380 A * 1/1999 Gambetti ..... 156/443

FOREIGN PATENT DOCUMENTS

CA 710630 * 6/1965 ..... 83/332

* cited by examiner

*Primary Examiner*—Stephen F. Gerrity
*Assistant Examiner*—Tara Ho
(74) *Attorney, Agent, or Firm*—Hedman & Costigan, P.C.

(57) ABSTRACT

An automatic machine for slitting and creasing paperboard sheets comprises, on a bearing framework, a plurality of assemblies for slitting and driving the paperboard sheets to be processed, the slitting and driving assembly including, each, slitting heads and driving heads, the slitting heads being coaxial with the driving heads and driven by a drive device which is independent from the drive device driving the driving heads.

14 Claims, 10 Drawing Sheets

20
11
3
36
37
35
40
30
31
18
10
C
21
60
13
48
46
50
49
59
47
45
12

10
11
12
13
18
19
21
30
35
36
37
40
45
46
49
59
60
C 10
11
12
13
18
19
20
21
26
26
30
31
35
36
37
40
41
45
46
59
60

AUTOMATIC MACHINE FOR SLITTING AND CREASING PAPERBOARD SHEETS AND THE LIKE

BACKGROUND OF THE INVENTION

The present invention relates to an automatic machine for slitting-and creasing paperboard sheets and the like.

As is known, prior apparatus for processing paperboard sheets, i.e. for making cross slits and creases on said paperboard sheets, are affected by great problems related to the difficulty of firmly holding or clamping the paperboard sheet as the slitting blades do not engage the paperboard material.

Moreover, the above mentioned prior apparatus must necessarily perform complex movements of the slitting heads, with respect to the paperboard material, with a consequent great difficulty related to the involved inertial forces as well as the location accuracy.

A further drawback of prior apparatus is that they are not operatively flexible and, in particular, cannot be quickly fitted to a lot of different processing requirements.

SUMMARY OF THE INVENTION

Accordingly, the aim of the present invention is to overcome the above mentioned drawbacks, by providing an automatic machine for slitting and creasing paperboard sheets and the like, allowing to firmly clamp the paperboard sheet being processed, independently from the slitting head location and drive.

Within the scope of the above mentioned aim, a main object of the present invention is to provide such an automatic machine having a high operating yield, and this by improving their slitting heads.

A further object of the present invention is to provide such an automatic machine allowing to make slits and creases in a paperboard sheet material according to a broad range of sizes, without the need of performing long adjusting operations.

Yet another object of the present invention is to provide a paperboard sheet slitting and creasing automatic machine which, owing to its specifically designed construction, is very reliable and safe in operation.

According to one aspect of the present invention, the above mentioned aim and objects, as well as yet other objects, which will become more apparent hereinafter, are achieved by an automatic machine for slitting and creasing paperboard sheets and the like, comprising, on a bearing framework, a plurality of slitting and driving assemblies for slitting and driving the sheets to be processed.

Said assemblies are each provided with respective slitting heads and driving heads.

The machine according to the invention is characterized in that the slitting heads are coaxial with the driving heads and are coupled to driving means independent from the driving heads driving means.

BRIEF DESCRIPTION OF THE DRAWINGS

Further characteristics and advantages of the present invention will become apparent hereinafter from the following disclosure of a preferred, though not exclusive, embodiment of an automatic machine for slitting and creasing paperboard sheets and the like, being shown, by way of an indicative, but not limitative, example, in the accompanying drawings, where.

DESCRIPTION OF THE PREFERRED EMBODIMENTS

Figure 1:
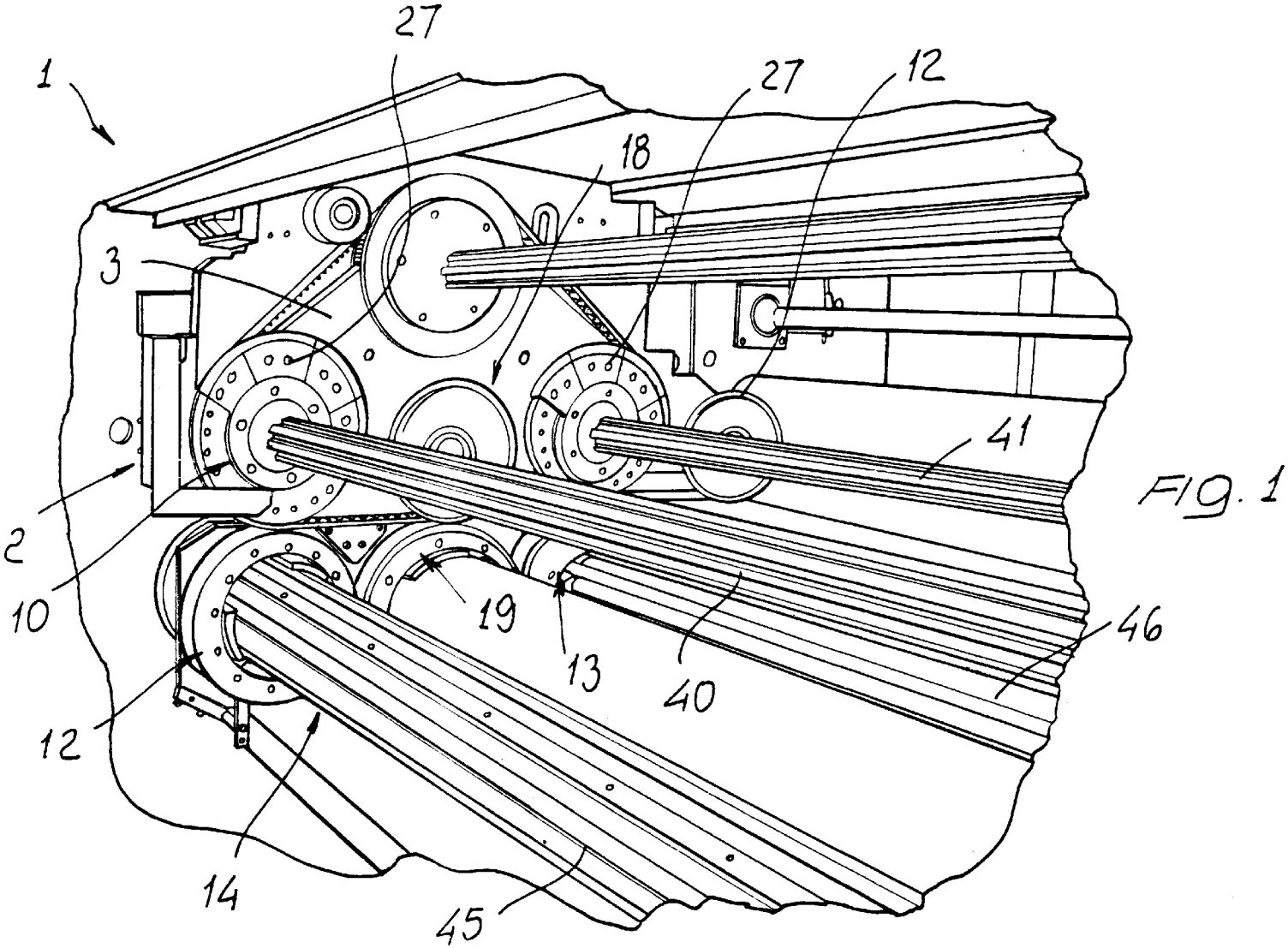
FIG. 1 is a perspective view illustrating the automatic machine according to the invention.
Figure 2:
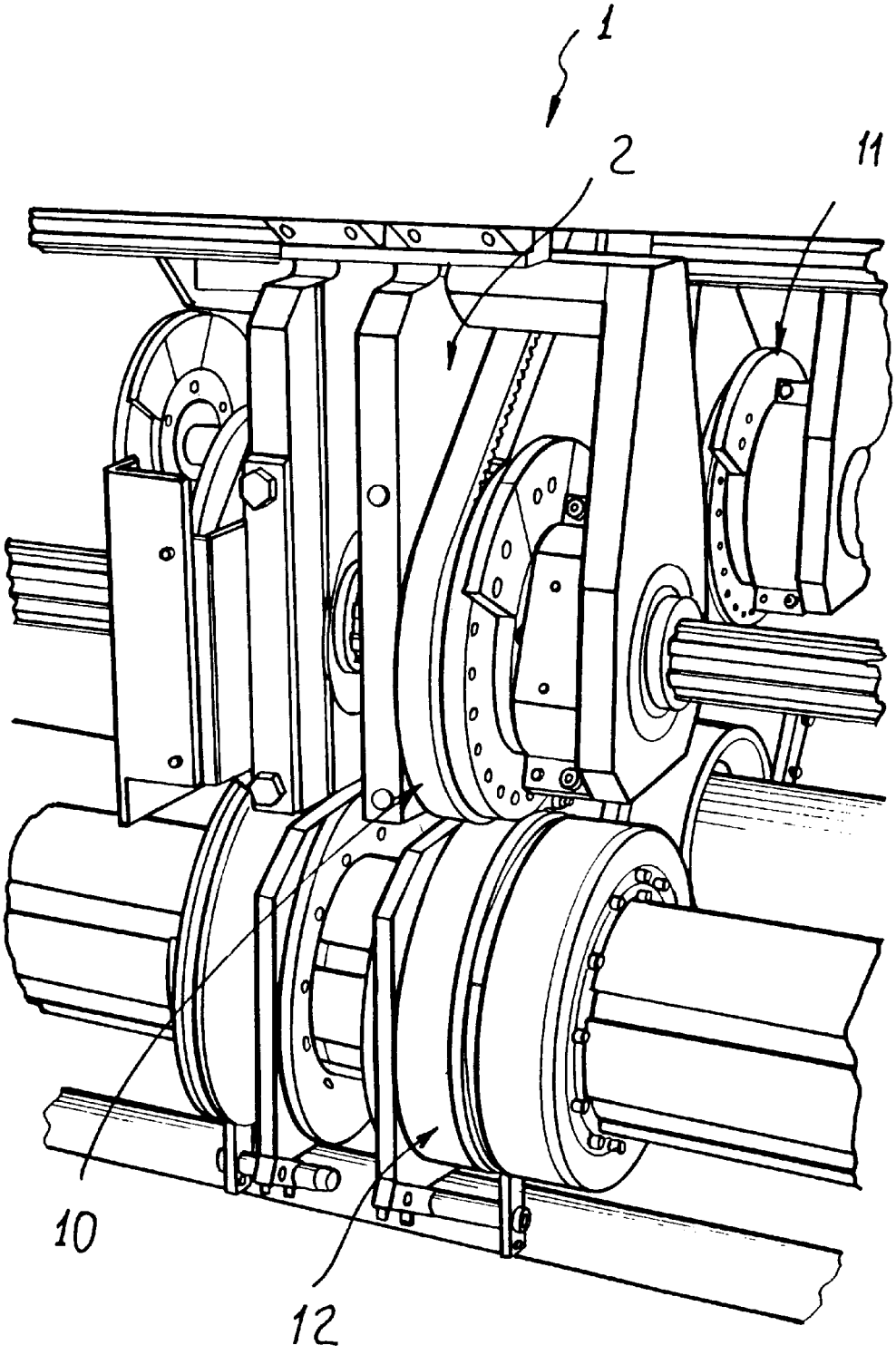
FIG. 2 is a further perspective view illustrating a detail of the slitting heads.
Figure 4:
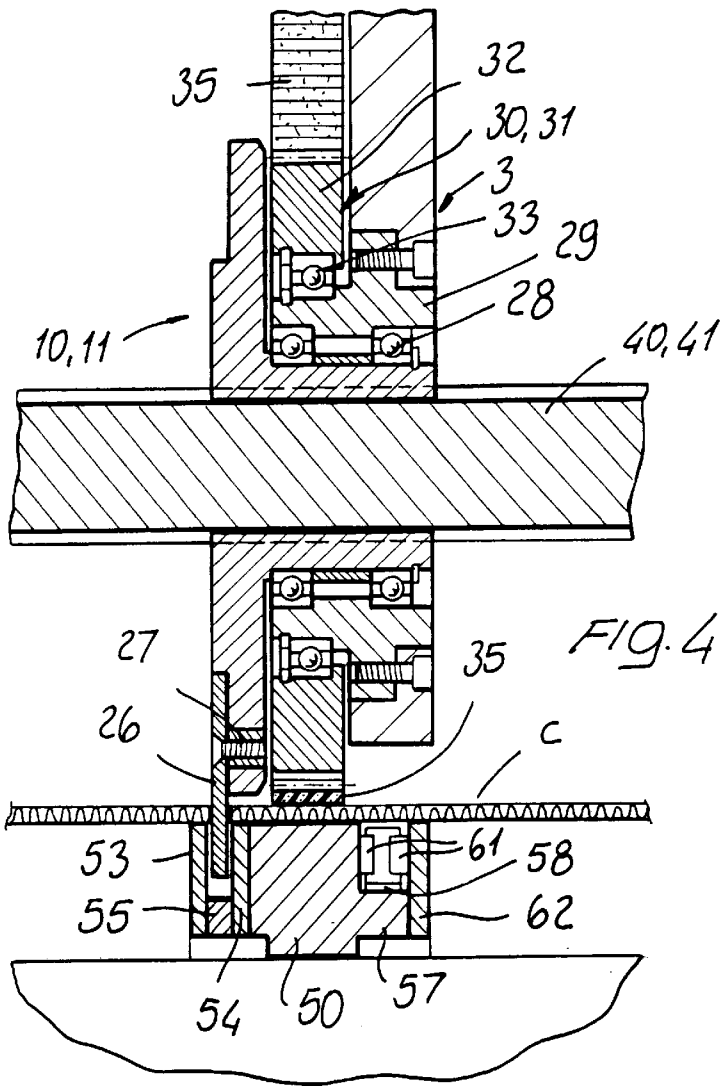
FIG. 4 is a further axial cross-sectional view illustrating a slitting head adjoining a driving head and engaging the paperboard sheet.

With reference to the number references of the above mentioned figures, the automatic machine for slitting and creasing paperboard sheets and the like, according to the present invention, comprises a bearing framework, generally indicated by the reference number 1, thereon a plurality of slitting and driving assemblies for respectively slitting and driving the paperboard sheets to be processed, as generally indicated by the reference number 2, are provided.

Each assembly 2 comprises a supporting carriage 3, which is driven on longitudinal beams 4, thereon guide wing or leg members 5 of said carriage 3 are engaged.

The driving of the carriage is provided by engaging rack 6 and gears 7 coupled to cross shafts 8, in turn driven: by a driving assembly, generally indicated by the reference number 9.

Each slitting assembly is provided with a front slitting head 10 and a rear slitting head 11, said heads being arranged at a respective front slitting counter-roller 12 and a rear slitting counter-roller 13.

Said rollers are supported, under the paperboard sheet displacement plane, indicated by C, and are supported by a bottom carriage 14 which can slide on horizontal guide bars 15.

Between the slitting rollers 10 and 11 and slitting counter-rollers 12 and 13 a creasing roller 18 and a corresponding counter-creasing roller 19 are provided: in this connection it should be apparent that the locations of these rollers could also be reversed.

Advantageously, it would also be possible to provide a pre-creasing roller 20 and a pre-creasing counter-roller 21, also mutually oppositely arranged with respect to the paperboard sheet displacement plane C.

Figure 3:
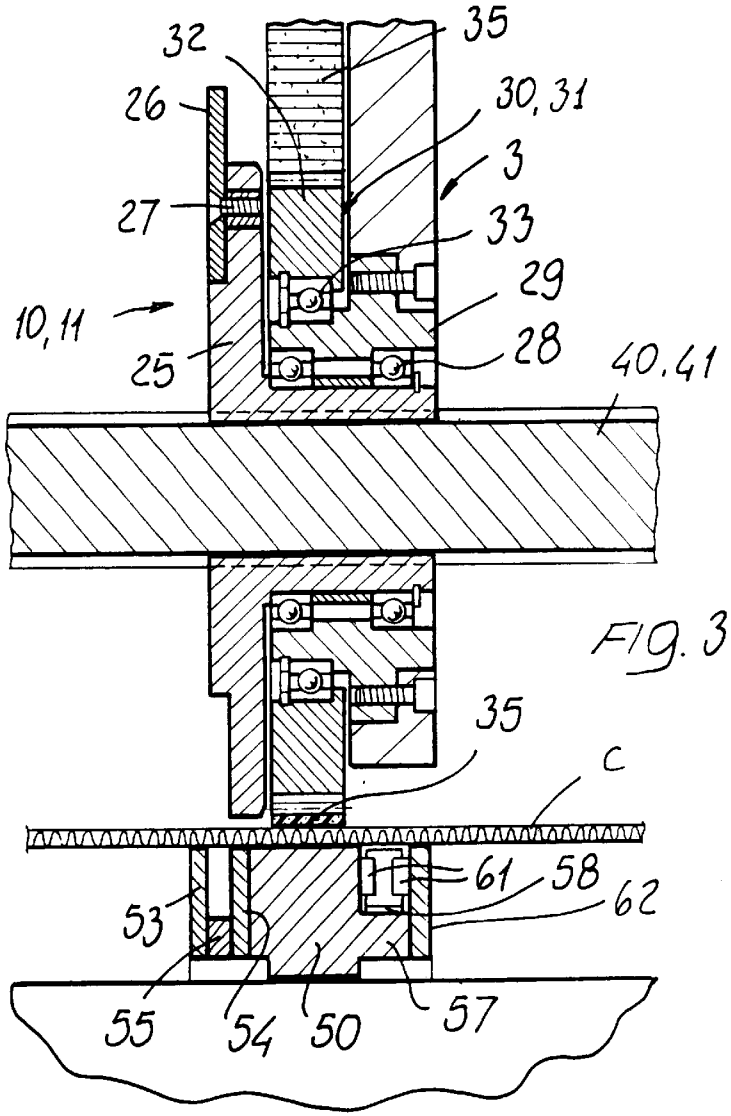
FIG. 3 is an axial cross-sectional view illustrating a slitting head and a driving head, the slitting head being disengaged from the paperboard material.
Figure 5:
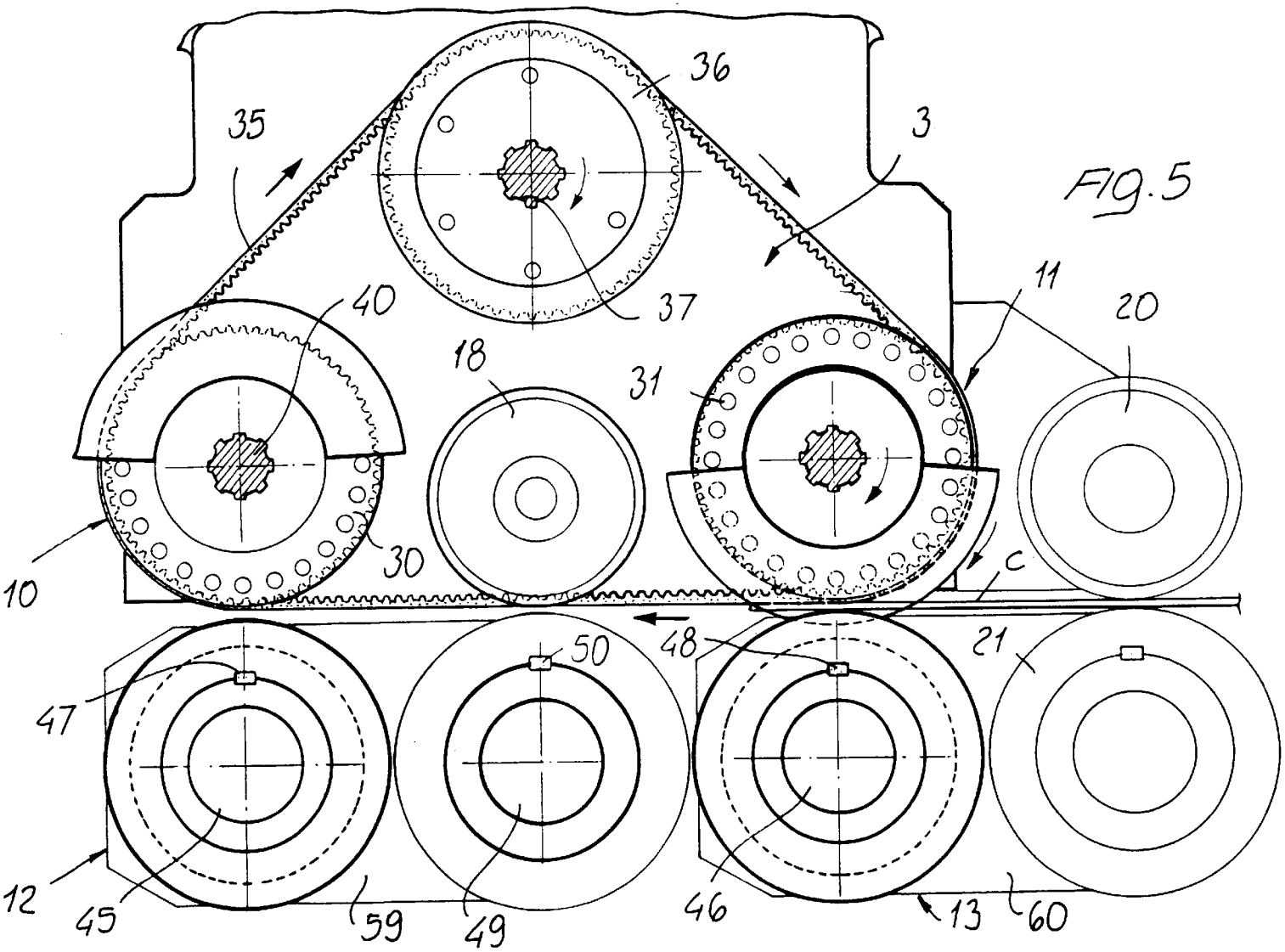
FIG. 5 illustrates, by a view transversal of the driving axes, the slitting and driving assembly with a slitting blade engaged with a paperboard sheet.
Figure 6:
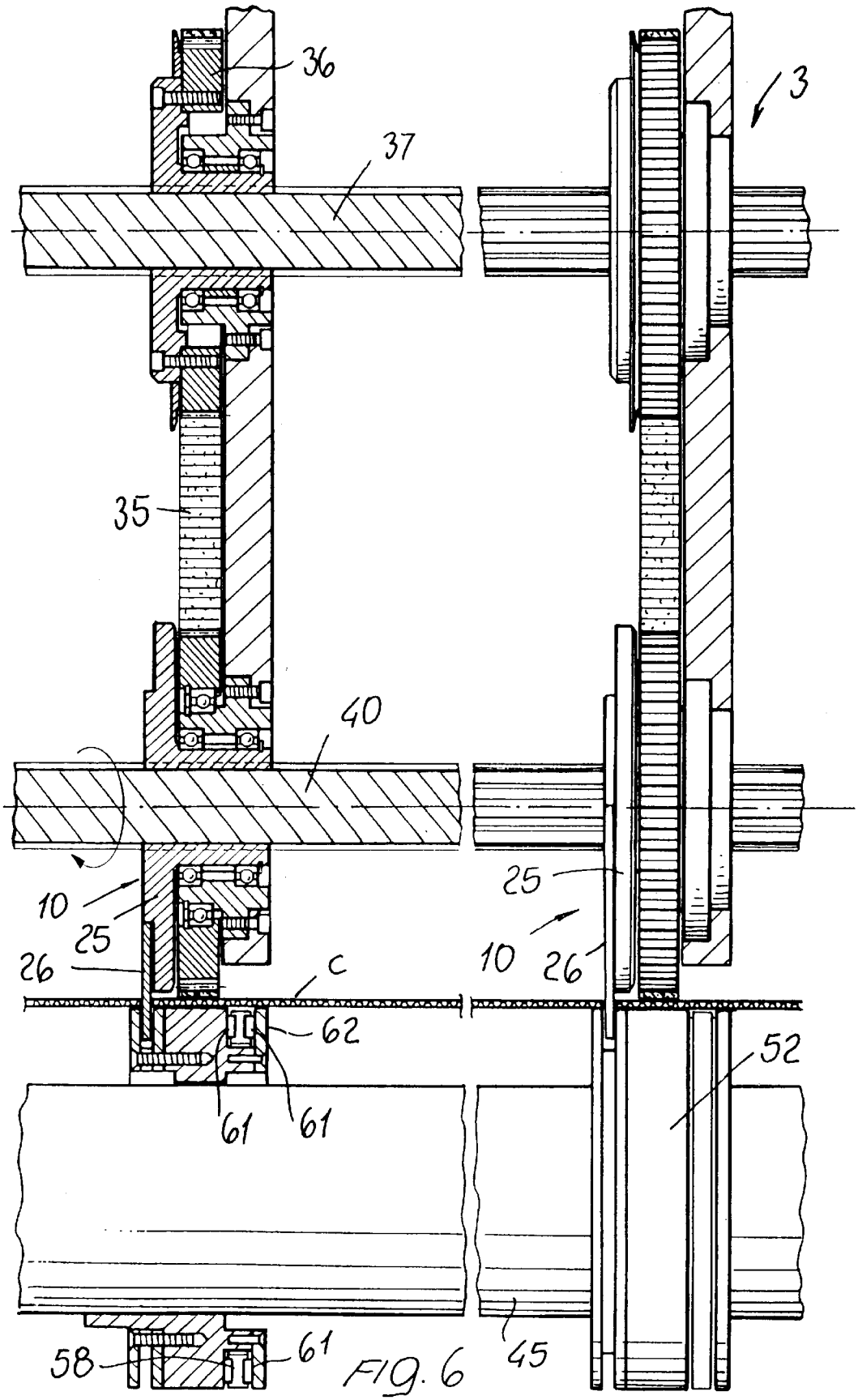
FIG. 6 is an axial cross-sectional view illustrating two slitting heads, both engaged with the paperboard sheet.
Figure 7:
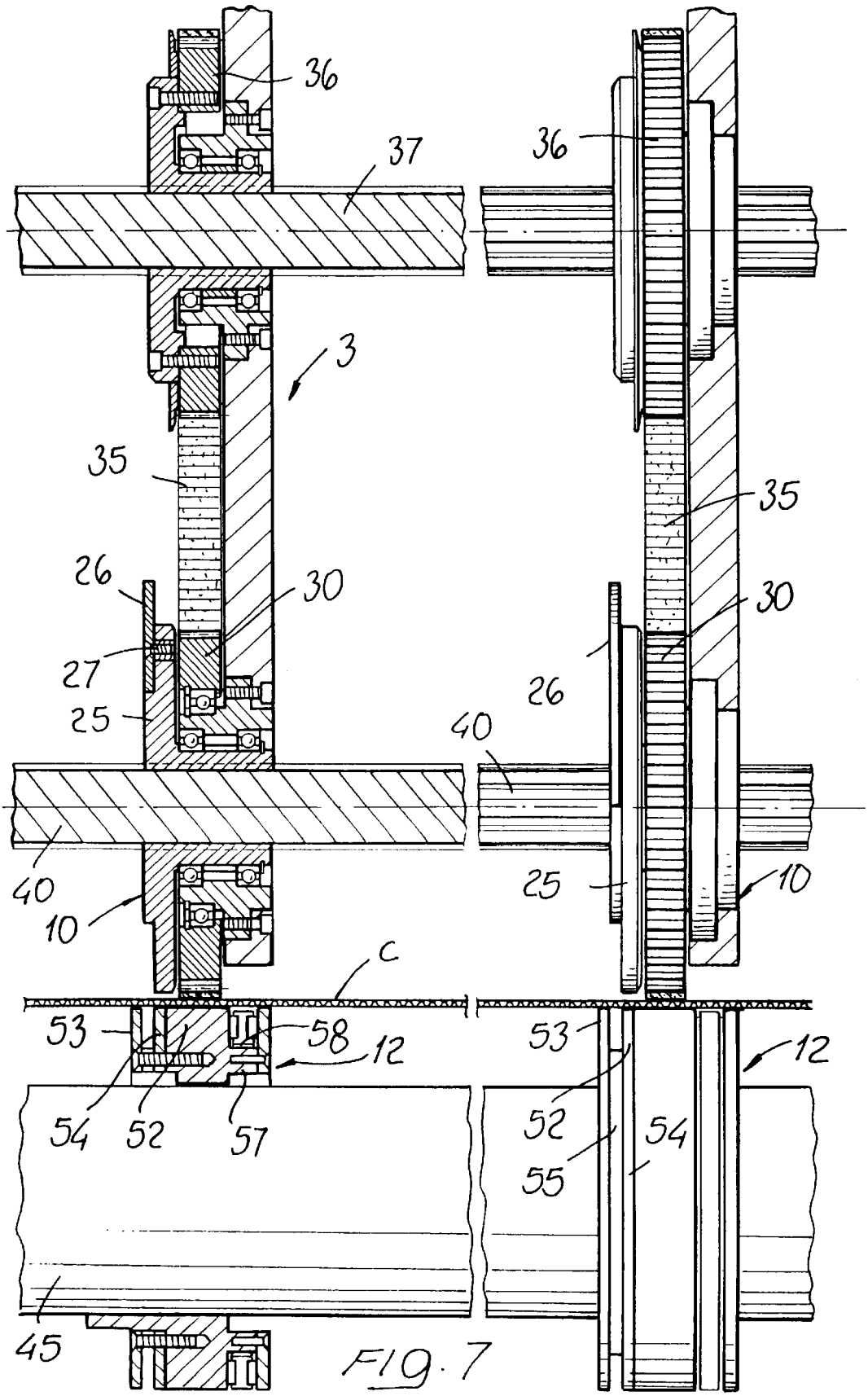
FIG. 7 is a further axial cross-sectional view illustrating two slitting heads, with their respective counter-slitting rollers and slitting blades disengaged from the paperboard sheet.
Figure 8:
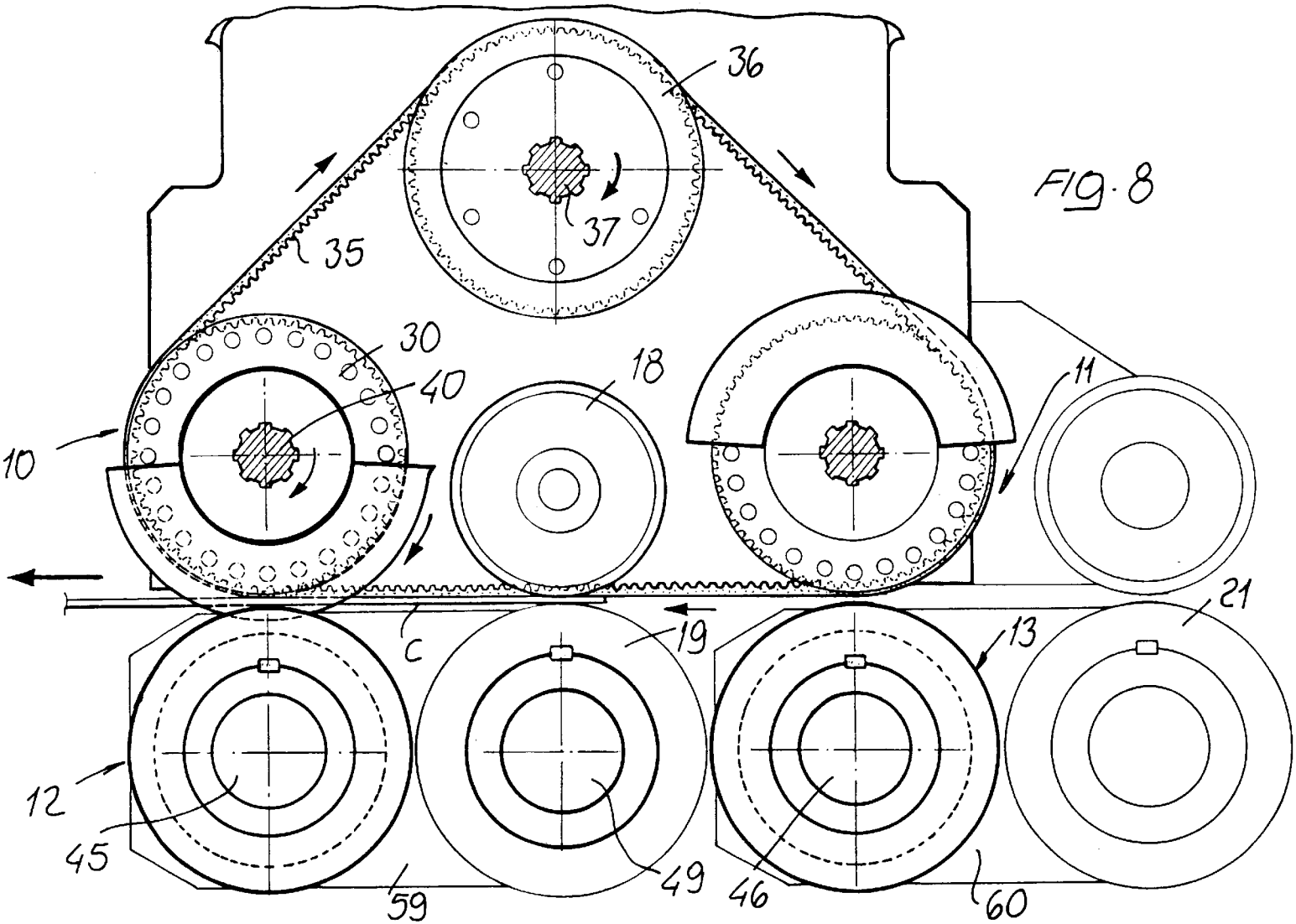
FIG. 8 is a view corresponding to FIG. 5, with a modified embodiment of the slitting blades engaged with the paperboard sheet.

Each of said slitting rollers 10 and 11 comprise, as is shown in FIG. 3, a disc 25 which, on a peripheral portion of the surface thereof, supports a plurality of slitting blades 26, extending for a circumferential portion and being coupled to the slitting bearing disc 15 by screws 27.

The disc 25 is supported, through the interposition of ball bearings 28, by a flange 29 coupled to the carriage 3.

Figure 12:
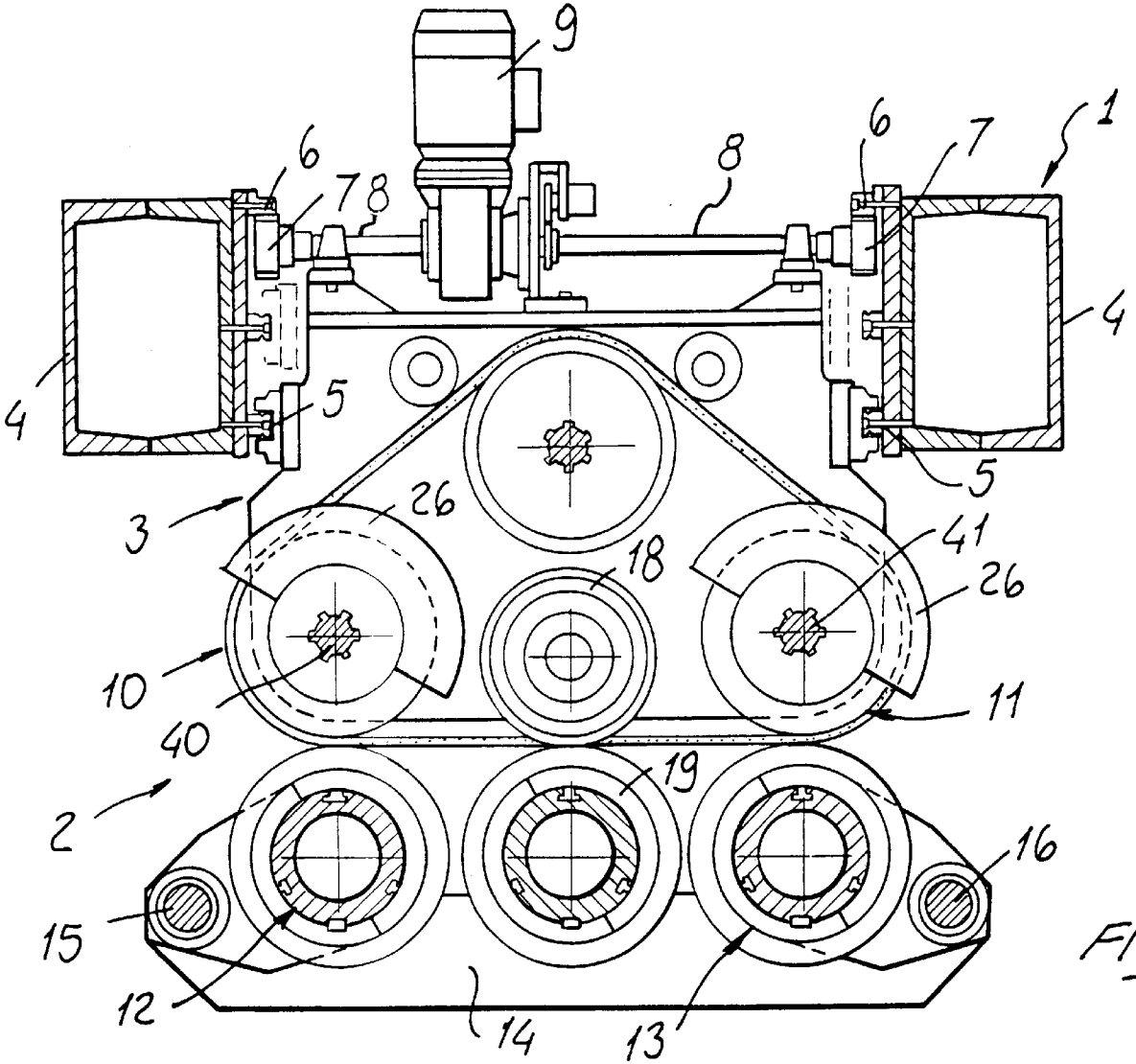
FIG. 12 schematically illustrates the automatic machine according to the invention, wherein a slitting assembly is clearly shown.

Said rollers are supported, under the paperboard sheet displacement plane, indicated by C, and are supported by a bottom carriage 14 which can slide on horizontal guide bars 15 and 16 (see for example FIG. 12)

To the gear wheels 32 of the driving heads 30 and 31 a toothed belt 35 is coupled, said belt constituting the driving element proper, which engages with the paperboard material C and being entrained on a driving gear wheel 36 which is supported by the carriage 3 and coupled to a shaft 37 rotatively driven by driving assemblies, arranged at the machine sidewalls, thereby operating as driving means for driving the paperboard sheets.

Each of said slitting rollers 10 and 11 comprise, as is shown in FIG. 3, a disc 25 which, on a peripheral portion of the surface thereof, supports a plurality of blades 26, extending for a circumferential portion and being coupled to the slitting bearing disc 25 by screws 27.

Said shafts are engaged with their related blade supporting or holding disc, to turn the slitting blade independently from the driving of the entraining or driving means, provided by the toothed belt 35 which is always held in engagement with the paperboard sheet C being processed, independently from the location of the slitting blade.

The counter-slitting rollers 12 and 13 are respectively supported by a bottom front shaft 45 and a bottom rear shaft 46, which are coupled by keys 47 and 48.

The counter-slitting roller, in particular, is supported by a bottom middle shaft 49, also coupled to its related roller by a key 50.

The counter-slitting rollers 12 and 13 are provided with a flat surface body 52, to be arranged under the driving belt 35.

At an axial end portion thereof, the body 52 supports counter-slitting discs 53 and 54 which are spaced by a spacer element 55, and provide the engagement zone for engagement with the respective slitting blade.

At the other end portion thereof, the body 52 defines an end-piece 57, engaging in a seat 58 defined by a bottom front plate 59 and a bottom rear plate 60, the latter being provided with anti-friction shoes 61 engaging with a rear flange 62 coupled to the end-piece 57.

The mentioned plate practically operates to hold in its desired position the body 52 and, accordingly, the discs 53 and 54, to allow the bottom carriage to be driven, which driving is obtained by engaging the slitting blades 26 between the counter-blades 53 and 54 thereagainst a pushing driving force is applied to provide the desired displacement along the related shafts.

Figure 9:
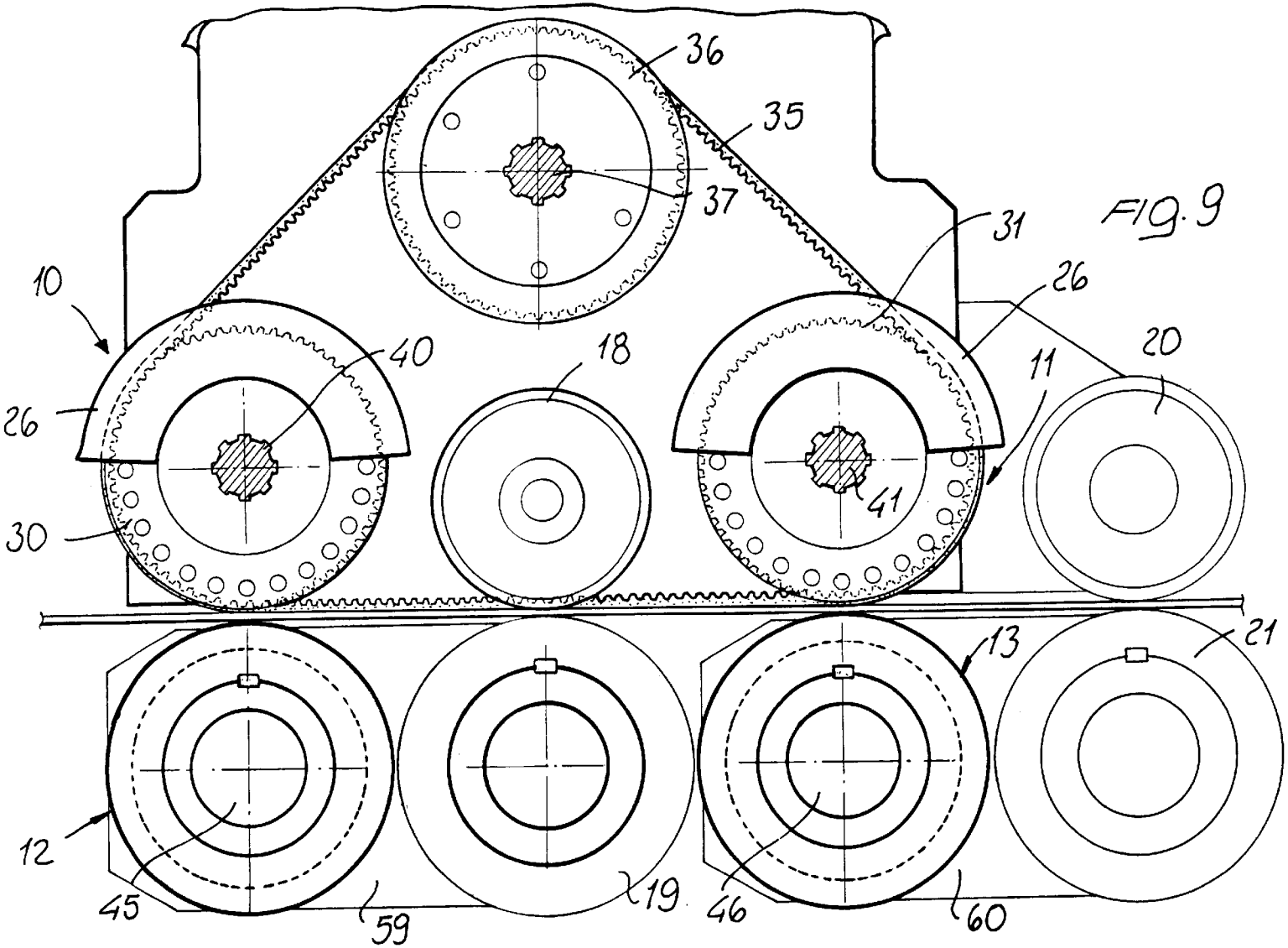
FIG. 9 illustrates a slitting assembly with the two slitting blades disengaged from the paperboard sheet.
Figure 11:
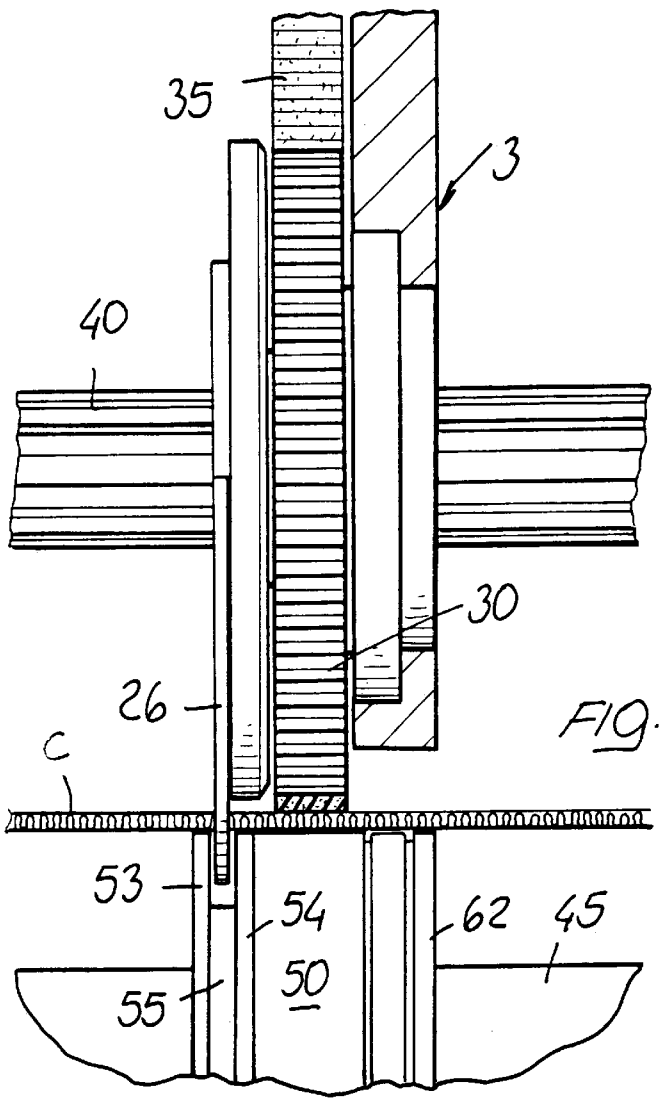
FIG. 11 illustrates a slitting head with the slitting blade engaged in the paperboard sheet.
Figure 10:
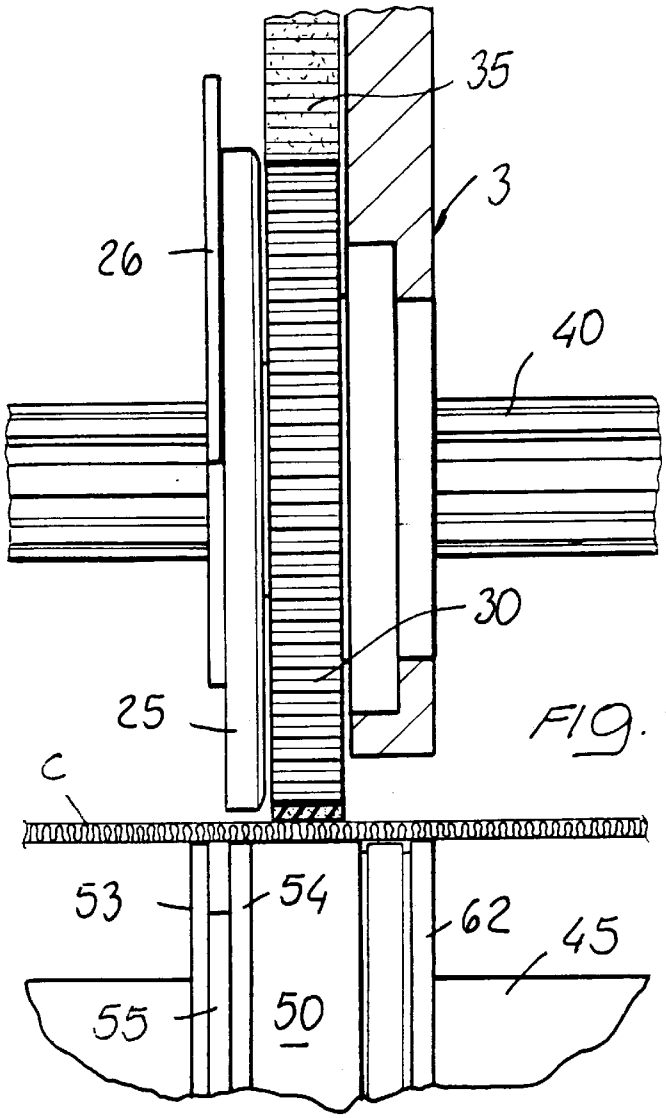
FIG. 10 illustrates a detail of a slitting head with a slitting blade disengaged from the paperboard sheet.

As is clearly shown in FIG. 9, each slitting blade axially drive a discrete slitter bearing disc, each of which axially drives its related guide plate.

Accordingly, said shafts can be driven independently from one another and, most importantly, independently from the top broached shaft 37 provided for driving the paperboard sheet by turning the top gear wheel 36 for driving the toothed belt.

The latter, jointly with the flat periphery of the body 52, provides a constant and synchronous displacement of the paperboard sheet during all the processing steps.

Each slitting assembly is designed for providing slits having a length greater than the extension of the individual mounted slitting blades, since it is possible to successively operate the front and rear blades, thereby the two blades, arranged in an aligned relationship, will perform both a cut portion at a lot of desired portions.

In operation, as two slits of 60 cm are to be made, for example, on the front and rear portions of the paperboard sheet C, and if the blades have a maximum extension of 40 cm each, then they will be driven to provide each a partial slit, but such that the sum of the slitting operations of each blade provides two slits of the desired length.

This result can be obtained, with respect to the maximum length of each slit, up to the sum of the length extension of the aligned slitting blades.

The machine according to the invention comprises moreover electronic control means and is so operated that the slitting blades can be switched off and held in a non operating condition, i.e. a stand by position.

This feature would allow the subject machine to operate as a cutting and creasing machine, by applying suitably designed additional circular blades.

The machine can be supplied either automatically by the provision of a paperboard sheet feeding assembly or it can also be manually supplied or fed by applying suitable guide bracket members.

The machine, in particular, is controlled by a photocell adapted to read the start of each inlet paperboard sheet, to provide a perfectly phased cut, even in a case of a uneven feeding.

From the above disclosure it should be apparent that the invention fully achieves the intended aim and objects.

In particular, the fact is to be pointed out that an automatic machine for slitting and creasing paperboard sheets and the like allowing to independently drive the slitting heads and driving heads has been herein provided.

Said machine has the great advantage of firmly holding the paperboard sheets in their set positions, even as the slitting blades are disengaged from the paperboard material.

The invention, as disclosed, is susceptible to several modifications and variations, all of which will come within the scope of the invention.

Moreover, all the constructional details can be replaced by other technically equivalent elements.

What is claimed is:

1. An automatic machine for slitting and creasing paperboard sheets, comprising, on a bearing framework, a plurality of slitting and driving assemblies for slitting and driving the paperboard sheets to be processed, each of said slitting and driving assemblies including slitting heads and driving heads driven by driving heads driving means, said slitting heads being coaxial with said driving heads and being coupled to slitting head driving means independent from said driving heads driving means, wherein each said slitting assembly is provided with a front slitting head and a rear slitting head, said front and rear slitting heads being arranged at a front counter-slitting roller and rear counter-slitting roller.

2. An automatic machine, according to claim 1, wherein each said slitting and driving assembly comprises a supporting carriage movably supported on longitudinal beams, said supporting carriage including a plurality of guide legs for engaging said longitudinal beams.

3. An automatic machine, according to claim 2, wherein said supporting carriage is driven by supporting carriage driving means comprising racks and gears coupled to cross shafts in turn driven by a driving assembly.

4. An automatic machine, according to claim 1, wherein said automatic machine comprises, between said front and rear slitting rollers and front and rear counter-slitting rollers, a creasing roller and a corresponding counter-creasing roller.

5. An automatic machine, according to claim 1, wherein said machine comprises, on the front of the slitting head, a pre-creasing roller and a pre-creasing counter-roller.

6. An automatic machine, according to claim 1, each slitting roller comprising a disc including, on a peripheral portion thereof, a slitting blade extending for a present circumferential portion, wherein said disc is supported by a flange coupled to said carriage through ball bearings.

7. An automatic machine, according to claim 1, wherein said machine comprises front and rear driving heads, said front and rear driving heads being arranged correspondingly to said front and rear slitting heads.

8. An automatic machine, according to claim 1, wherein said driving heads comprise a gear wheel rotatably supported with respect to said flange, with the interposition of bearings.

9. An automatic machine, according to claim 1, wherein said slitting heads driving means comprise a front broached shaft and a rear broached shaft, engaging with corresponding blade bearing discs to turn the respective slitting blade, independently from said driving means.

10. An automatic machine, according to claim 1, wherein said front and rear counter-slitting rollers are supported by a bottom front shaft and a bottom rear shaft coupled by keys, said counter-slitting rollers being provided with a flat surface to be arranged under said driving belt.

11. An automatic machine, according to claim 1, wherein said counter-slitting rollers comprise counter-slitting discs, supported by a supporting body and spaced from one another by a spacing element, said counter-slitting discs defining an engagement zone for a blade.

12. An automatic machine, according to claim 1, wherein said body of said counter-slitting rollers is designed for respectively engaging in a seat defined by a bottom front plate and a bottom rear plate, each of said plates being provided with anti-friction shoes engaging with a rear flange coupled to an end piece.

13. An automatic machine, according to claim 12, wherein each slitting blade is designed for axially driving a splitter bearing disc for axially driving a related guide plate.

14. An automatic machine, according to claim 13, wherein said front and rear splitting blades are successively driven to perform cuts having a length greater than the maximum length of each blade.

* * * * *